US005309611A

United States Patent [19]

Wier et al.

[11] Patent Number: 5,309,611

[45] Date of Patent: May 10, 1994

[54] BUCKLE FOR VEHICLE SAFETY BELT SYSTEMS

[75] Inventors: Franz Wier, Göggingen; Hans-Peter Betz, Böbingen; Christian Hoika, Vellberg-Lorenzenzimmern, all of Fed. Rep. of Germany

[73] Assignee: TRW Repa GmbH, Alfdorf, Fed. Rep. of Germany

[21] Appl. No.: 60,157

[22] Filed: May 11, 1993

[30] Foreign Application Priority Data

May 12, 1992 [DE] Fed. Rep. of Germany ..... 4215563

[51] Int. Cl.[5] ..... A44B 11/00

[52] U.S. Cl. ..... 24/633; 24/641

[58] Field of Search ..... 24/633, 641, 642, 643, 24/640, 636, 629, 602, 603, 606; 297/468, 480

[56] References Cited

U.S. PATENT DOCUMENTS

| | | | |
|---|---|---|---|
| 4,384,341 | 5/1983 | Lindblad et al. | 24/633 |
| 4,972,559 | 11/1990 | Haglund . | |
| 5,008,989 | 4/1991 | Wedler et al. | 24/633 |
| 5,066,042 | 11/1991 | Fohl | 297/480 |
| 5,097,571 | 3/1992 | Fohl | 24/641 |
| 5,142,749 | 9/1992 | Biller . | |
| 5,163,207 | 11/1992 | Krautz et al. . | |
| 5,213,365 | 5/1993 | Fohl | 24/633 |

FOREIGN PATENT DOCUMENTS

| | | | |
|---|---|---|---|
| 212507 | 3/1987 | European Pat. Off. . | |
| 3537465 | 4/1987 | Fed. Rep. of Germany . | |
| 2553637 | 4/1985 | France | 24/633 |

*Primary Examiner*—Victor N. Sakran

*Attorney, Agent, or Firm*—Tarolli, Sundheim & Covell

[57] ABSTRACT

A buckle for vehicle safety belt systems provided with a pretensioner engaging the buckle, is prevented by a locking pawl (42) from unintentional opening at the beginning and at the end of a pretensioning stroke. By the effect of its mass inertia at the start of the pretensioning stroke an inertial body moves the locking pawl (42) into a locking position in which the release button (30) is prevented from moving in a direction relative to the base in the pretensioning direction (R). Due to the location of its center of gravity relative to its mounting position the locking pawl (42) at the end of the pretensioning stroke remains in the locking position and is decoupled from the inertial body (56).

8 Claims, 4 Drawing Sheets

BUCKLE FOR VEHICLE SAFETY BELT SYSTEMS

BACKGROUND OF THE INVENTION

The present invention relates to a buckle for vehicle safety belt systems provided with a pretensioner engaging the buckle.

Buckles for safety belt systems are known in a great many different versions. In one configuration, which has become popular, the load-bearing base of the buckle has an insertion path for the tongue of the belt and a latch slidably guided or swivably mounted on the base transversely to the insertion path to interact with a detent opening of the tongue. A locking member slidably guided parallel to the insertion path in the base holds the latch in its latched position as long as the release button, which is also slidably guided parallel to the insertion path on the base, is in its rest position. This release button is coupled to the locking member, to move it, when actuated, to a release position in which the latch releases from the detent opening of the tongue.

Using such a lock in safety belt systems having a pretensioner is no problem when the pretensioning force engages, for example, on the belt retractor. Pretensioners have also been proposed which are effective between the buckle and its fastening point on the vehicle body or a vehicle seat. Pretensioners of this kind shorten the distance between the fastening point of the buckle and the buckle itself by a few centimeters, for example 10 cm.

The force required for pretensioning can be produced mechanically by means of strongly dimensioned spring or pyrotechnically. If the pretensioning force is sufficiently high, particularly when pyrotechnical pretensioning drive means are used, it may occur in certain cases that the buckle automatically opens at the beginning or at the end of the pretensioning stroke.

Automatic opening of the buckle as a consequence of the pretensioning stroke is attributed to the mass inertia of the release button and of any components acting thereon. For example, at the end of its pretensioning stroke, the release button tends to continue its movement in the pretensioning direction corresponding to the operating direction of the release button.

One way of counteracting a continued movement of the release button under the effect of the forces of inertia is to provide a locking pawl which under the influence of its mass inertia is movable transversely to the direction of pretensioning and which at the end of a pretensioning stroke, when the buckle is abruptly decelerated, assumes a position in which it prevents further movement of the release button in to its release position. A buckle designed on the basis of this principle is disclosed, for instance, by U.S. Pat. No. 5,097,571. Activation of the locking pawl involves a movement of the release button in the direction of the release position; accordingly, the release button must implement some idle travel. The locking pawl prevents the release button from being shifted into the release position. It must be ensured that the locking pawl obtains its locking position before the release button moves past the point at which locking by means of the locking pawl is no longer possible. This requirement restricts the freedom of selecting and dimensioning components for the buckle.

Other known means of counteracting movement of the release button on a pretensioning stroke consist in using compensating inertial bodies, however, this is often disqualified, particularly when space availability is limited.

SUMMARY OF THE INVENTION

The present invention provides a buckle for safety belt systems in vehicles provided with a pretensioner acting on the buckle which, in particular, has an inertially controlled locking means which is capable of being integrated easily into existing buckles, offers a high safety margin and requires no idle travel of the release button.

According to the invention the buckle comprises a base wherein an insertion path is defined to receive a tongue having a detent opening. The base defines an abutment edge. A latch is mounted on the base which interacts with the detent opening. A release button has a cap portion and is mounted on the base to be slidable in a release stroke parallel with the insertion path to release the latch from the detent opening. A swivable two-armed lever has a first arm forming a locking pawl and a second arm angled with respect to said first arm. This lever is fitted into the cap portion of the release button and is movable in the cap portion between a normal rest position wherein the locking pawl is spaced from the abutment edge and a locking position wherein the locking pawl, on movement of the release button in a release stroke, engages the abutment edge to stop the release button in its release stroke. A spring member preloads the lever to said normal rest position. An inertial body is movable in the cap portion of the button between first and second positions. The inertial body is spring-loaded to said first position and movable from said first to said second position by inertial forces occurring upon acceleration of the buckle in a first direction, said inertial body, upon movement from its first to its second position, engaging the two-armed lever to move said locking pawl to said locking position. The lever tends to move towards said locking position upon acceleration of said buckle in a second direction opposite said first direction.

In the buckle of the invention, the release button is locked already at the start of the pretensioning stroke and remains in its locking position at the end of the pretensioning stroke. On the one hand, a way was found of implementing positioning of the locking pawl by using the forces of acceleration arising at the start of lock movement by making use of a separate inertial body—its mass being available at the locking pawl practically exclusively to provide the work required in shifting, since the inertial body is movable in more or less the direction opposite the pretensioning direction—and, on the other, the locking position of the locking pawl was selected so that it remains in its locking position and is uncoupled from the inertial body as soon as the direction of acceleration is reversed, due to the location of its center of gravity relative to its pivotal axis at the end of the pretensioning stroke. This separate inertial body also permits optimum adaptation of the locking pawl to its actual purpose and locating it at places in the lock which were hitherto inaccessible in prior art, where, in general, vacant space is available, i.e. in the cap portion of the release button, so that many components of existing buckle systems to be provided with a pretensioner can continue to be used unmodified. Reliable movement of the locking pawl into the locking position is achieved with less restraints than in prior art so that both the locking pawl and the inertial body permit optimum adaptation to a preexisting configuration.

One example of such an adaptation is evident from the preferred embodiment in which the locking pawl is a two-armed angled lever mounted at the common base-point of its two arms in the vicinity of one corner of an angled cap of the release button so that it is a snug fit in the cap. One of the arms of the lever extends more or less in the direction of action of the release button and carries a pawl tip which in its locking position is located opposite an abutment edge of the base. The other arm contacts the preloading means so that the abutment edge is not normally in the way of the pawl tip. The inertial body is a control lever or pawl which by means of ramp surfaces located parallel to each other and inclined at an acute angle to the pretensioning direction contacts the side of the locking pawl arm facing away from the cap and carrying the pawl tip. On a pretensioning stroke the ramp surfaces slide on each other and produce an effective boost of the force providing exceptionally reliable functioning. In this embodiment the locking pawl, the control pawl and the preloading means can all be arranged compactly in the region of the overhead cap of the release button, i.e. spaced away from other lock safety-relevant components which can also be taken over unmodified from existing series production. At the same time the cap over the locking pawl and the control pawl as well as their elevated arrangement constitute means of reliable dirt protection.

The buckle according to the invention can also be easily adapted to various existing systems, because the mass of the inertial body, the spring force of the one or more means of preloading and, where applicable, the lengths of the lever arms of the locking pawl and the inclination of the ramp surfaces of the locking pawl or of the inertial body all offer a variety of means of being adapted to each other to ensure reliable engagement of the locking pawl.

The inertial body can be held in its rest position by the force of gravity alone. When, on the other hand, the locking pawl is loaded by one end of a spring, the other end of which loads the inertial body in the form of a control pawl mounted on the release button, reliable protection is provided against unintentional locking. Also after the belt has been tensioned the locking pawl is returned to its rest position, so that the buckle can be reliably opened.

BRIEF DESCRIPTION OF THE DRAWINGS

Further features and advantages of the invention are evident from the following description of preferred embodiments and from the drawing to which reference is made, wherein.

DESCRIPTION OF PREFERRED EMBODIMENT

Figure 1:
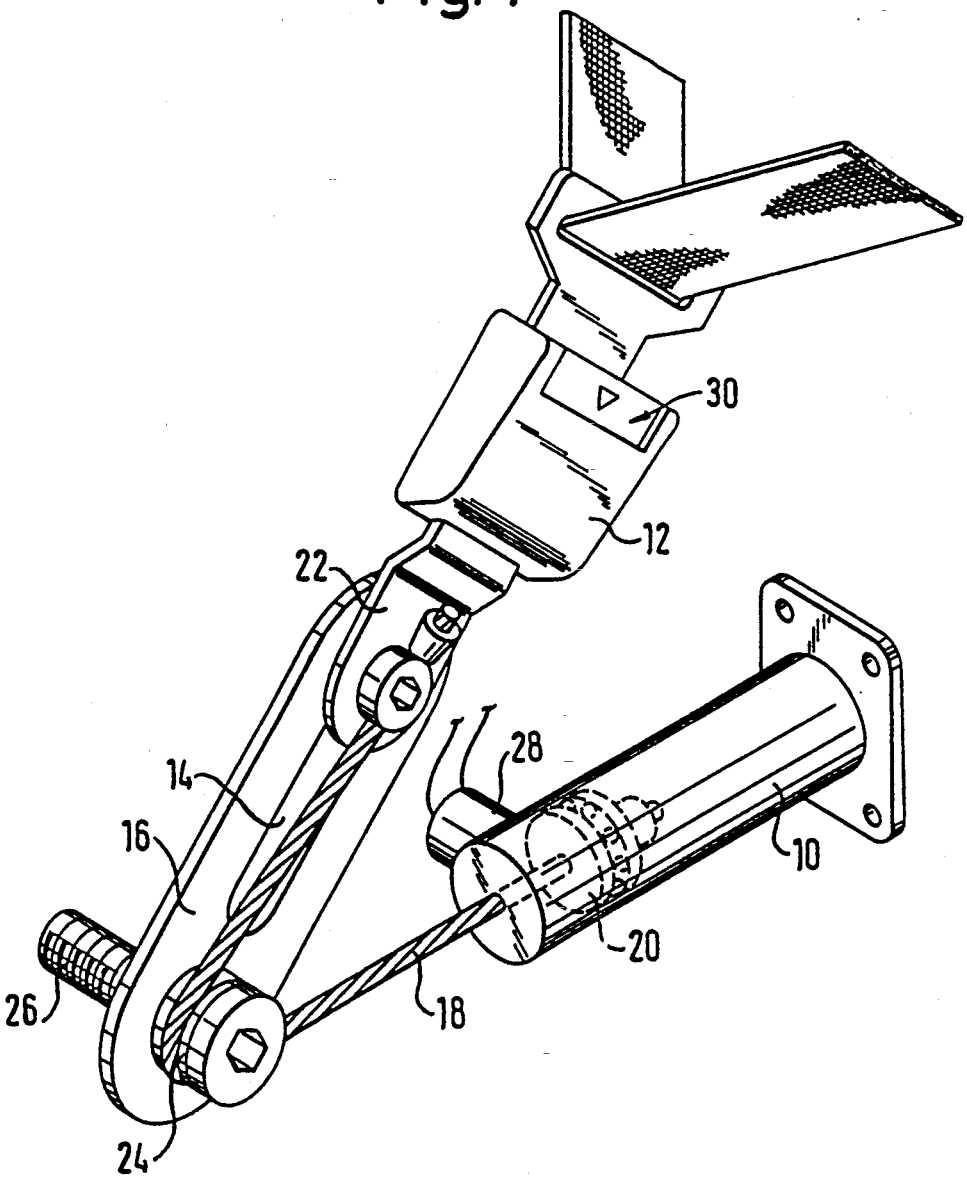
FIG. 1 is a schematic perspective view of a pretensioner, engaging a belt buckle.

The pretensioner shown in FIG. 1 comprises a pyrotechnical piston/cylinder pretensioning drive 10, a longitudinal guide for the belt buckle 12 in the form of an anchoring plate 16 provided with a slot 14, a cable 18 which connects the piston 20 to the fastener 22 of the belt buckle 12, and a deflector pulley 24 for guiding the cable 18 and which is mounted on a fastening pin 26 firmly jointed to the vehicle. When the pretensioner is activated the piston 20 is loaded by the compressed gases generated by a pyrotechnical gas generator 28, and draws the belt buckle 12 via the cable 18 downwards. At the bottom end of the slot 14 the movement of the belt lock 12 is abruptly decelerated.

This abrupt deceleration of the buckle 12 produces high inertial forces at its release button 30 oriented in the direction of the release movement of the latter which can result in unintentional opening.

Means of locking the release button 30, preventing its movement relative to the buckle 12 on a pretensioning stroke are now described with reference to the FIGS. 2 to 6.

The release button 30 comprises an angled cap 32 and a slider 34 extending into the buckle 12 and interacting via ramp surfaces 36 (FIGS. 4, 5) with a latch 38 for a tongue (not shown). Depressing the release button 30 causes the latch 38 extending into an opening in the load-bearing base 40 to be withdrawn from the opening sufficiently to free the tongue. Inside the cap 32 a locking pawl 42 in the form of an angled two-armed lever is swivably mounted about an axis 44 located in the vicinity of an internal corner of the angled cap 32 and perpendicular to the plane of FIGS. 2 and 3. The locking pawl 42 has an elongated arm 46 extending more or less in the actuating direction R of the release button 30 in accordance with the pretensioning movement. The end of the arm 46 facing away from the axis 44 of the locking pawl 42 is defined as a pawl tip 48. The base 40 has an abutment edge 50 past which the pawl tip 48 is able to move unobstructed in a normal rest position (FIGS. 2 and 4) of the locking pawl 42 when the release key 30 is depressed. In a locking position (FIGS. 3 and 5) the arm 46 of the locking pawl 42 is swivelled towards the outside of the cap 32 so that the abutment edge 50 is located at a slight distance away from the pawl tip 48 in its path of movement in the pretensioning direction R.

The locking pawl 42 further has an arm 52 oriented more or less at right angles to the arm 42. The angled arrangement of the locking pawl 42 causes it to assume a snug fit at a slight distance away in the inner corner of the angled cap 32. The arm 52 is engaged by one of the legs of a leg spring 54 to hold it in the rest position, pressed against the slider 34 connected to the cap 32.

Figure 2:
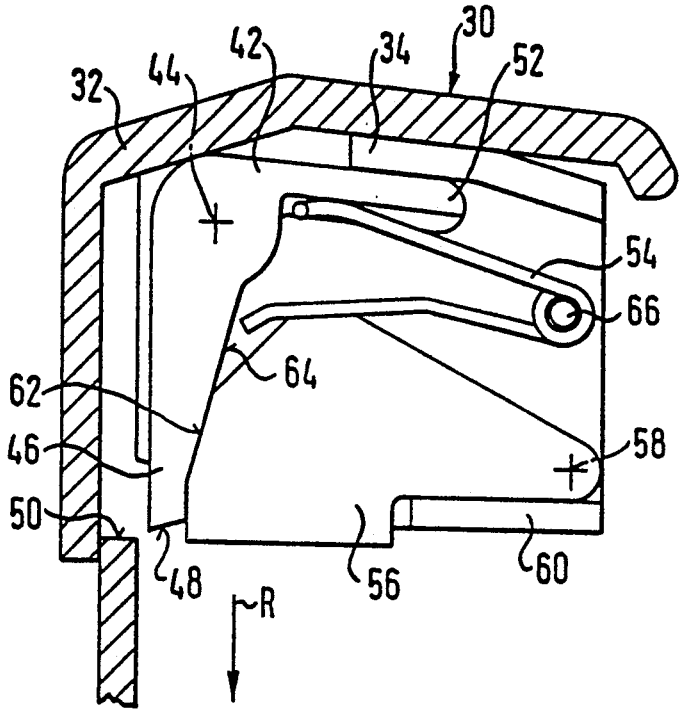
FIG. 2 is a partial cross section of the lock shown in FIG. 1 in the region of the release button, whereby locking pawl and control pawl are in a normal position.
Figure 3:
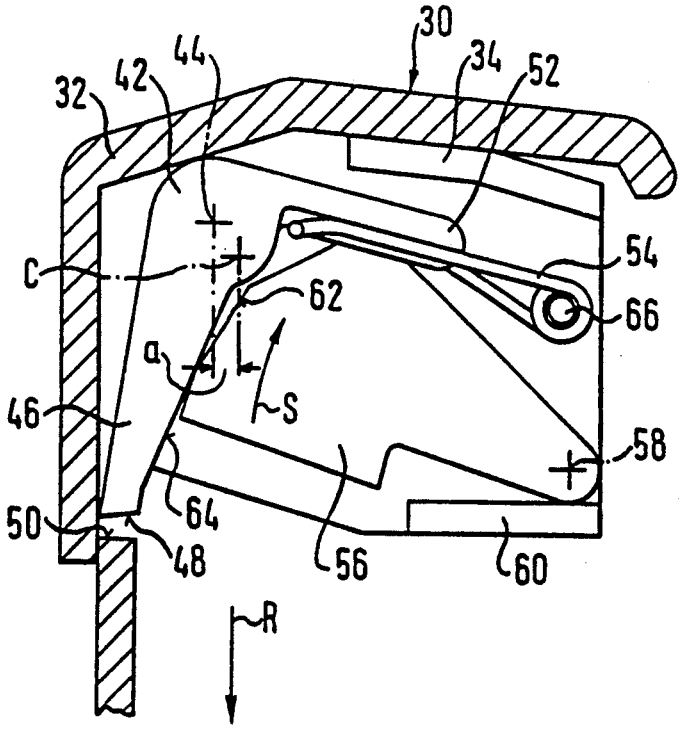
FIG. 3 is a partial cross section of the lock shown in FIG. 1 in the region of the release button, whereby locking pawl and control pawl are displaced.

A control pawl 56 is swivably mounted on a spindle 58 oriented normally to the plane of FIGS. 2 and 3 at the release button 30. The other leg of the leg spring 54 engages the control pawl 56 and forces it against a stop 60 firmly jointed to the base. The control pawl 56 has a ramp surface 62 inclined at an acute angle to the pretensioning direction R. The ramp surface 62 contacts a matching ramp surface 64 on the inside of the arm 46 of the locking pawl 42. The control pawl 56 is configured so that it requires no more room than the locking pawl 42 in the pretensioning direction R. Control pawl 56 and locking pawl 42 form a compact assembly accommodated within the cap 32 of the release button 30.

The leg spring 54 can be formed of wire and slided over an axis 66 connected to the release button 30 (FIGS. 2 and 3). Alternatively the leg spring 54 can be formed of bent spring plate and supported with any degree of closure between locking pawl 42 and control pawl 56 (FIGS. 4 and 5).

Figure 4:
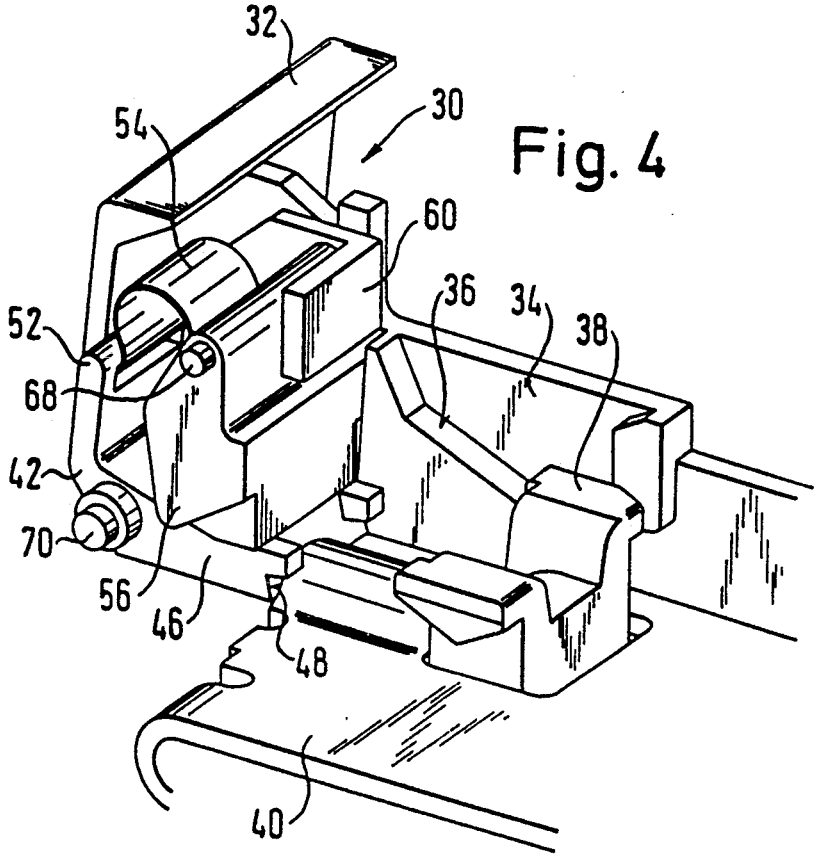
FIG. 4 is a partial perspective view corresponding to FIG. 2.
Figure 5:
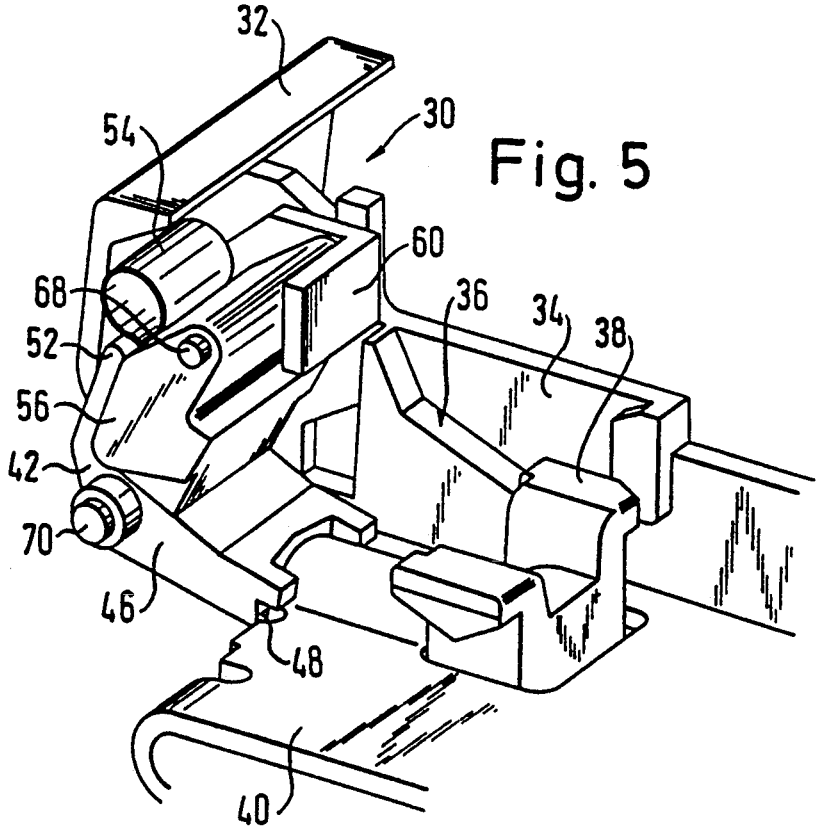
FIG. 5 is a partial perspective view corresponding to FIG. 3.

As evident from FIGS. 4 and 5, locking pawl 42 and control pawl 56 are axially mounted in corresponding holes (44, 58 in FIGS. 2, 3) of the release button 30 by means of integrally molded projections 68, 70.

When the pretensioning drive 10 is activated and the belt buckle 12 pulls in the direction of pretensioning R, the control pawl 56 overcomes the force of the leg spring 54 dimensioned for the resulting acceleration to swivel out of the position shown in FIGS. 2 and 4 respectively in the direction of the arrow S (FIG. 3) into the position shown in FIGS. 3 and 5 respectively. The swivelling force of the control pawl 56 is transmitted as boosted via the ramp surfaces 62, 64 to the locking pawl 42 so that the return force exerted by the leg spring 54 on the locking pawl 42 is overcome and the locking pawl is swivelled into the locking position shown in FIGS. 3 and 5 respectively in which a movement of the release button 32 in the pretensioning direction R is blocked. In this position the center of gravity C of the locking pawl 42 is located at a sufficient distance a away from the line passing through the axis 44 parallel to the direction R so that the abrupt deceleration of the buckle 12 resulting at the end of the pretensioning movement produces a moment at the locking pawl 42 causing it to tend to remain in its locking position. Locking pawl 42 and control pawl 56 are then returned to their normal positions by means of the leg spring 54 so that the lock 12 can be normally opened.

Due to the elevated and protected (by cap 32) arrangement of the moving parts of the locking mechanism, any soilage possible after lengthy use of the vehicle is effectively prevented. This is significant not only as regards the reliable response of the locking mechanism but also in view of reliable opening of the buckle following vehicle collision.

Figure 6:
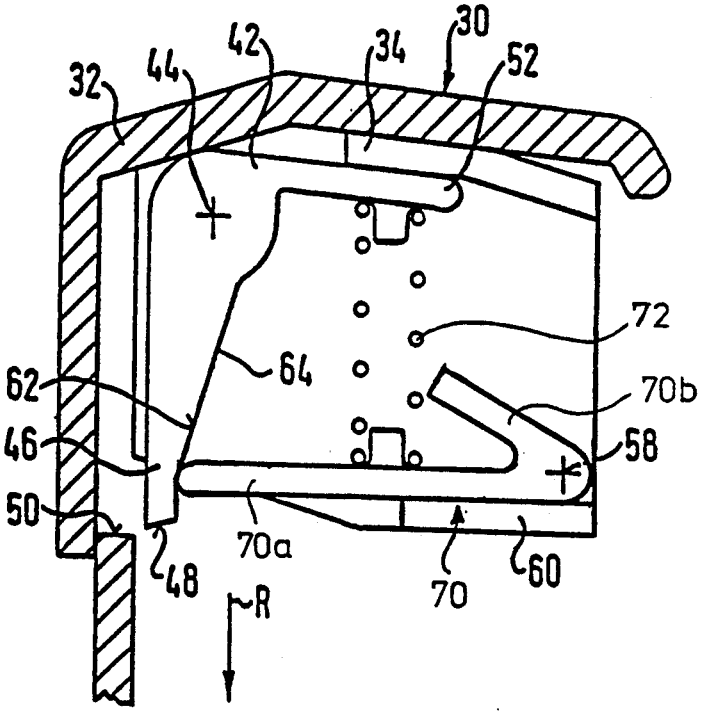
FIG. 6 is a partial cross-section of an alternative embodiment.

In the alternative embodiment of FIG. 6, the inertial body is formed as a two-armed lever 70 having a longer arm 70*a* and a shorter arm 70*b* angled in V-manner, the lever 70 being pivotally mounted at 58 in the cap 32. The free end of the longer arm 70*a* engages the pawl 46 on its free end, as shown in FIG. 6. A pressure spring 72 is engaged between arm 70*a* and arm 52. Operation of this embodiment is similar to that of the preceding embodiment.

We claim:

1. A buckle for vehicle safety belt systems provided with a pretensioner engaging the buckle, comprising a base wherein an insertion path is defined to receive a tongue having a detent opening, said base defining an abutment edge, a latch mounted on the base which interacts with said detent opening, a release button having a cap portion and mounted on said base to be slidable in a release stroke parallel with the insertion path to release said latch from said detent opening, a swivable two-armed lever having a first arm forming a locking pawl and a second arm angled with respect to said first arm, said lever being fitted into said cap portion and being movable in said cap portion between a normal rest position wherein said locking pawl is spaced from said abutment edge and a locking position wherein said locking pawl, on movement of said release button in a release stroke, engages said abutment edge to stop said release button in its release stroke, a spring member preloading said lever to said normal rest position, and an inertial body movable in said cap portion between first and second positions, said inertial body being spring-loaded to said first position and movable from said first to said second position by inertial forces occurring upon acceleration of said buckle in a first direction, said inertial body, upon movement from its first to its second position, engaging said lever to move said locking pawl to said locking position, and said lever tending to move towards said locking position upon acceleration of said buckle in a second direction opposite said first direction.

2. A buckle as set forth in claim 1, wherein a common spring member is provided for preloading said lever to its rest position and simultaneously preloading said inertial body to said first position.

3. A buckle as set forth in claim 1, wherein said inertial body in said first position is spring-loaded into engagement with the first arm of said lever.

4. A buckle as set forth in claim 1, wherein said inertial body is formed by a lever pivotally mounted in said cap portion and said spring member is a pressure spring engaged between said lever and the second arm of said two-armed lever.

5. A buckle for vehicle safety system which has a pretensioner for moving said buckle, said buckle comprising:

a base defining an insertion path to receive a tongue which has a detent opening, said base defining an abutment edge;

a latch mounted on the base which interacts with the detent opening;

a release button having a cap portion, said release button being mounted on said base to be slidable in a release stroke parallel with the insertion path to release said latch from the detent opening;

a movable two-armed lever having a first arm forming a locking pawl and a second arm angled with respect to said first arm, said lever being movably mounted to said release button and being located within said cap portion, said lever being movable relative to said cap portion between a rest position and a locking position, said locking pawl being spaced from said abutment edge and said release button being slidable in the release stroke when said lever is in the rest position, said locking pawl being engageable with said abutment edge to stop said release button and to prevent the release stroke when said lever is in the locking position;

a spring member biasing said lever to the rest position; and an inertial body movably mounted to said release button and being located within said cap portion, said inertial body being movable relative to said cap portion and said lever between a first position and a second position, said inertial body being biased to the first position and being movable from the first position to the second position by inertial forces occurring upon acceleration of said buckle in a first direction, said inertial body engaging said lever and moving said lever to said locking position upon movement of said inertial body from the first position to the second position, and said lever tending to move towards the locking position in response to force which tends to decelerate the movement of said buckle, in the first direction and tending to accelerate said buckle in a second direction opposite said first direction.

6. A buckle as set forth in claim 5, wherein said spring member extends between said lever and said inertial body for biasing said lever to the rest position and simultaneously biasing said inertial body to the first position.

7. A buckle as set forth in claim 5, wherein said inertial body in the first position is spring-loaded into engagement with said first arm of said lever.

8. A buckle as set forth in claim 5, wherein said inertial body is formed by an inertial lever pivotally mounted in said cap portion and said spring member is a pressure spring engaged between said inertial lever and said second arm of said two-armed lever.

* * * * *